US007498903B2

(12) United States Patent
Kamenopolski

(10) Patent No.: US 7,498,903 B2
(45) Date of Patent: Mar. 3, 2009

(54) DIGITAL PHASE SHIFTER

(75) Inventor: Stanimir Kamenopolski, Sofia (BG)

(73) Assignee: Raysat Cyprus Ltd., Nicosia (CY)

( * ) Notice: Subject to any disclaimer, the term of this patent is extended or adjusted under 35 U.S.C. 154(b) by 176 days.

(21) Appl. No.: 10/554,448

(22) PCT Filed: Apr. 30, 2004

(86) PCT No.: PCT/BG2004/000008

§ 371 (c)(1),
(2), (4) Date: Sep. 12, 2006

(87) PCT Pub. No.: WO2004/097972

PCT Pub. Date: Nov. 11, 2004

(65) Prior Publication Data

US 2007/0030098 A1 Feb. 8, 2007

(30) Foreign Application Priority Data

Apr. 30, 2003 (BG) ..... 107771

(51) Int. Cl.
*H01P 3/00* (2006.01)

(52) U.S. Cl. ..... 333/164; 333/139

(58) Field of Classification Search ..... 333/161, 333/162, 164, 139, 262
See application file for complete search history.

(56) References Cited

U.S. PATENT DOCUMENTS

| | | | | |
|---|---|---|---|---|
| 5,081,706 | A * | 1/1992 | Kim | 455/78 |
| 6,054,907 | A | 4/2000 | Sjogren | |
| 6,275,121 | B1 | 8/2001 | Sasaki et al. | |
| 2002/0153967 | A1 | 10/2002 | Nakada | |

FOREIGN PATENT DOCUMENTS

| | | | |
|---|---|---|---|
| EP | 0 547 615 | A | 6/1993 |
| EP | 1 195 841 | A | 4/2002 |
| JP | 2001 203502 | A | 7/2001 |

OTHER PUBLICATIONS

Patent Abstracts of Japan: vol. 2000, No. 24, May 11, 2001.

* cited by examiner

*Primary Examiner*—Don P Le
(74) *Attorney, Agent, or Firm*—D. Kligler IP Services Ltd.

(57) ABSTRACT

Digital phase shifter, comprising series connection of controlled phase shifting bits (3*a*-3*k*), each of them inserts determinate amount of phase delay of the passing signal, wherein the phase change occur in response to the control signal switching the phase cells 3*k* and applied to its steering terminal 4*k* for a switching element (11, 21, 22, 31, 32) of each of the cells 3, characterized in applying as a switching element (11,21,22,31,32) the discrete p-HEMT (pseudomorphic high electron mobility transistors) with positive or negative pinch-off voltage.

17 Claims, 5 Drawing Sheets

DIGITAL PHASE SHIFTER

This application is a national stage application of co-pending PCT application PCT/BG2004/000008 filed Apr. 30, 2004, which was published in English under PCT Article 21(2) on Nov. 11, 2004, which claims priority to Bulgarian patent application ser. no. 107771, filed Apr. 30, 2003. The disclosures of these applications are expressly incorporated herein.

FIELD OF THE INVENTION

The present invention pertains to the microwave digitally controlled phase shifter, which can be used in different field of communications, where the change of signal phase is needed. The digital phase shifter is suitable for phased array antennas for beam steering and polarization tilt compensation. The invention can be used also as a phase modulator (BPSK or QPSK).

PRIOR ART

The present digital phase shifters use as switching component p-i-n diodes and FETs (filed effect transistor) implemented on MESFET (metal semiconductor field effect transistors) or p-HEMT (pseudomorphic high electron mobility transistors) technologies. Discrete phase shifters build with p-i-n diodes despite of their excellent microwave properties has some drawbacks like high power consumption, complicated driving circuitry and relatively large switching time. Application of FETs overcomes those imperfections. Solid-state phase shifter based on FETs is described in US patent US003545239. It is 5 bit device and uses the following phase shifting cells: loaded line, hybrid coupled reflection type, Hi-low pass type and Schiffman type. Utilized GaAs FETs are three terminal devices. Implementation of phase shifters as a microwave monolithic integrated circuit (MMIC) is step forward in their development improving the reliability, frequency band, operating frequency and yields the devices with more compact dimensions. Well-known shortcomings of monolithic phase shifters are the required large initial financial investment, inability for postproduction tuning and high insertion loss compared to discrete counterparts, due to GaAs substrate. Listed drawbacks gives some advantage in utilization of discrete phase shifters for application in units like: engineering models of phased array antennas, polarization control devices, phase modulators and other devices requiring not so large number of phase shifters. Discrete phase shifter using FETs is described in US005128639. It is three bit device utilizing only hybrid coupled reflection type phase shifting cells build with coupled line hybrid circuitry and three terminal FETs. The phase shifter works at 1.6 GHz with 8% bandwidth and ±10° absolute phase error.

SUMMARY OF THE INVENTION

It is a general object of presented invention to provide a low cost digital phase shifter with easier manufacturing and tuning, and reliable performance.

In accordance with the above object, there is provided a phase shifter apparatus, comprising series connection of controlled phase shifting bits, each of it inserts certain amount of phase delay of the passing signal, the phase change occur in response to the control signal switching the phase cells and applied to its steering terminal. Typical feature of the digital phase shifter is application of discrete p-HEMT (pseudomorphic high electron mobility transistors) with positive or negative pinch-off voltage.

In one preferred embodiment at least one of the switching cells is from loaded line type and comprises one switching component for phase change, loading network and impedance matching networks, the switching element works as a grounded switch with two sources connected to the common ground, drain connected to loaded impedance network and gate connected to the control terminal through decoupling circuitry.

In this embodiment impedance matching networks is appropriate to be implemented as a quarter wavelength transformer, single open stub Γ-network and through loading of the transmission line with reactance compensating the reactive loading from the switch and loading network.

It is appropriate loading impedances to be implemented as a transmission line sections with length about λ/4 and/or λ/8 having determinate characteristic impedance, and tapered lines for smooth transition toward the switch.

In other version of this embodiment decoupling circuitry comprises two sections of transmission lines and/or resistor.

In other version of this embodiment loading impedance consists of series connection of quarter wavelength transformer, λ/8 transmission line and tapered line.

It is appropriate decoupling networks to be based on cascade connection of high impedance λ/4 transmission line and low impedance λ/4 open stub.

It is also appropriate matching networks to be implemented as a λ/4 transformer, single open stub Γ-network or through loading of the transmission line with capacitive reactance.

In other preferred embodiment digital phase shifter comprises two switching components, impedance matching networks and decoupling networks, connected to the gates of the p-HEMTs, the control terminal is between two decoupling networks.

In this embodiment is appropriate the loading impedances to have the same configuration as loading impedance but quarter wavelength transformers are bended on 0°, 45° and 90°.

It is also appropriate decoupling networks to be the same as decoupling network, but to use radial open stub and high impedance λ/4 transmission line to be bended as well.

In other digital phase shifter embodiment at least one of the phase shifting bits is from hybrid coupled reflection type and consists of two switching components changing the value or reflective loads, they are connected to the transmission line by the hybrid, the drains of switching p-HEMTs are connected to the hybrid through reflective loads, and their gates are connected through decoupling network to the control terminal. The source terminals of p-HEMTs are grounded.

In this version is appropriate the hybrid to be implemented as a branch-line coupler, coupled line directional coupler, Lange coupler, hybrid ring coupler with 90° compensation or theirs discrete elements counterparts.

In other preferred embodiment the phase shifter comprises single-section branch-line coupler, and two reflective loads are equal and consist of series connection of transmission line section with characteristic impedance Zo, tapered transmission line section, transmission line section with characteristic impedance Z1, tapered transmission line section, transmission line section with characteristic impedance Z2 and tapered transmission line section.

In other preferred embodiment the digital phase shifter comprises double-section branch-line coupler, and two reflection loads are equal and consist of series connection of transmission line section with characteristic impedance Zo, tapered transmission line section, transmission line section with characteristic impedance Z1, tapered transmission line section, transmission line section with characteristic impedance Z2 and tapered transmission line section.

The advantage of digital phase shifter according to the innovation are in it construction facilitating manufacturing and tuning, which provide low-cost and high performance of the final device.

DETAILED DESCRIPTION OF THE PREFERRED EMBODIMENT

Figure 1:
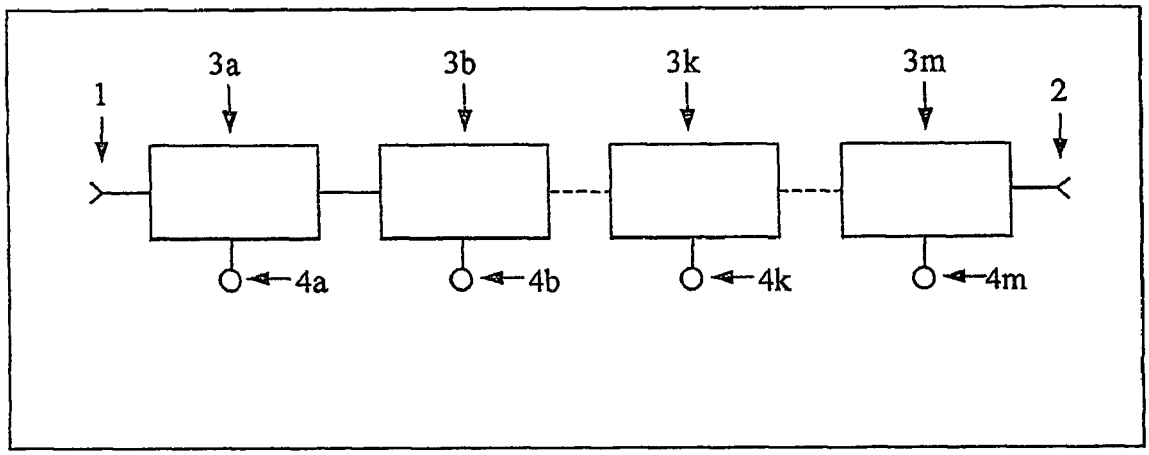
FIG. 1 is a block diagram of apparatus incorporating the present innovation.
Figure 2:
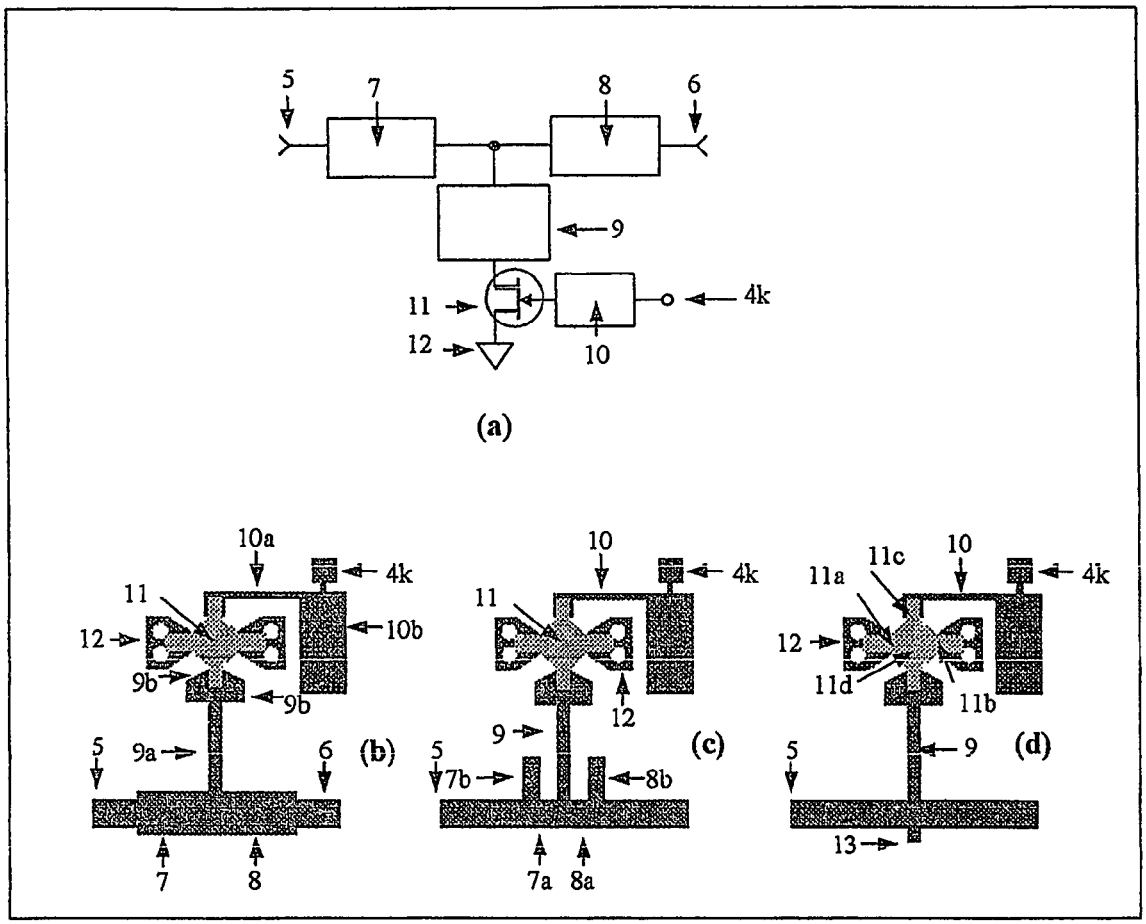
FIG. 2*a* is electrical circuit of loaded line phase shifting bit.
FIGS. 2*b*, 2*c*, 2*d* is physical layout of loaded line phase shifting bit.
Figure 3:
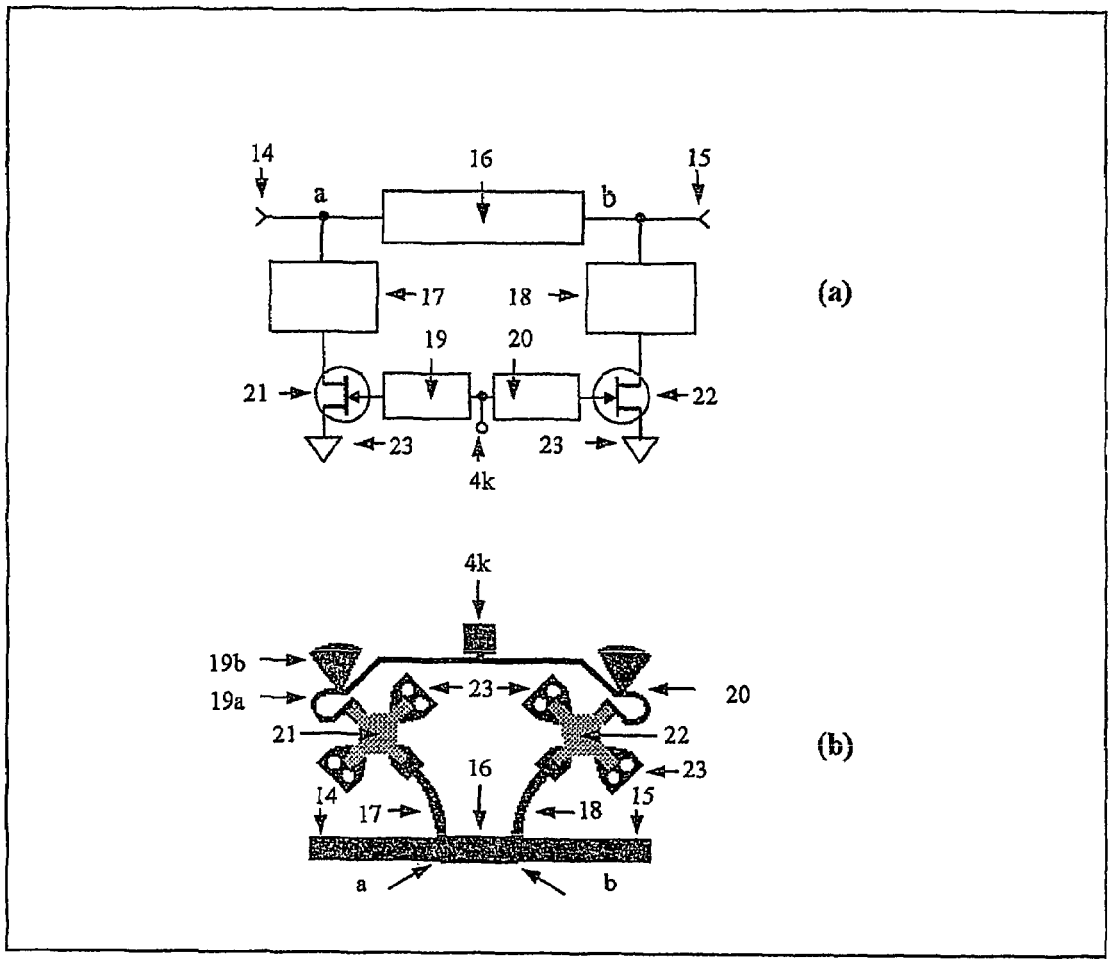
FIG. 3*a* is electrical circuit of periodically loaded line phase shifting bit.
FIG. 3*b* is physical layout of periodically loaded line phase shifting bit.
Figure 4:
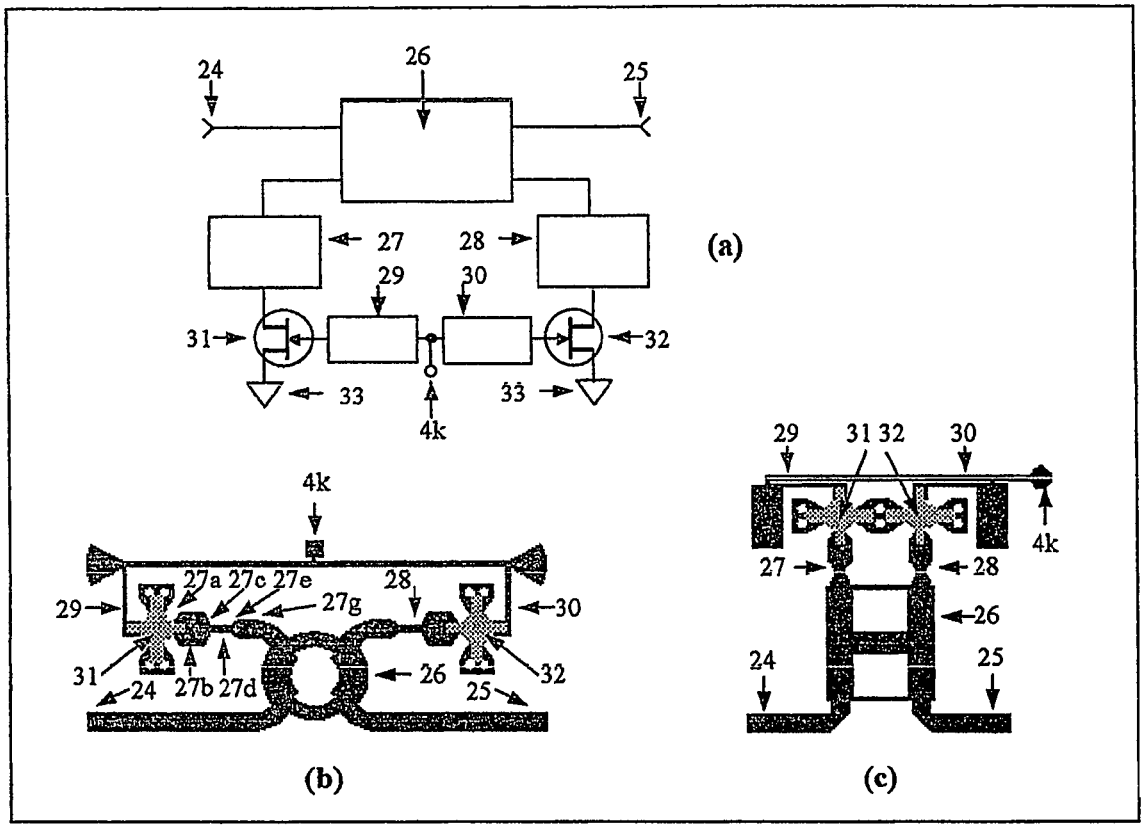
FIG. 4*a* is electrical circuit of reflection type hybrid coupled phase shifting bit.
FIG. 4*b* is physical layout of reflection type hybrid coupled phase shifting bit using single-section branch-line coupler implemented on microstrip technology.
FIG. 4*c* is physical layout of reflection type hybrid coupled phase shifting bit using double-section branch-line coupler implemented on microstrip technology.

The apparatus depicted in FIG. 1, comprises series connection of phase shifting bits 3*a*-3*m*, each of it contributing to overall phase delay of passing signal. The number of phase shifting bits depends on device application and has the value in range of 1 to 7. The generation of additional phase delay is achieved by switching of cretin number of phase delay cells 3*k* in response to the signal applied to control terminal 4*k* of each cell 3. Each one of phase shifting bits 3 can be implemented with the circuits shown in FIGS. 2, 3 and 4. All of these circuits use pseudomorphic high electron mobility transistors (p-HEMT) (11, 21, 22, 31 and 32) as a switching component, which is the core of presented innovation. This type of discrete transistors is mass-produced and is offered from variety of vendors. Their main applications are in low noise microwave amplifiers and mixers. The most of discrete p-HEMTs are four terminal devices with two sources and are suitable for application as a grounded switch with zero voltage between drain and source. Application of discrete p-HEMT as a grounded switch is not so popular due to lack of design parameters normally provided by manufacturer. Precise measurement of could p-HEMT parameters makes their application possible and facilitates the design of matching networks. The circuit depicted in FIG. 2*a* is novel, it is loaded line phase shifting bit, which uses only one switching component 11 for the change of the insertion phase delay. The principal of operation is the following: the transmission line 5 is loaded with switching reactance created by discrete p-HEMT 11 and loading impedance network 9, as a result the phase of transmission coefficient is changed. Due to this perturbation the input-output impedances of the cell deviate from their optimal value, to shift them back, the impedance matching networks 7 and 8 are added, which guarantee the operation in required bandwidth. Different types of matching can be used for implementation of matching networks 7 and 8, for instance: quarter wavelength transformer, single open stub Γ-network and through loading of the transmission line with reactance compensating the reactive loading from the p-HEMT switch 11 and loading impedances 9. The loading network 9 provides needed loading impedance and also compensates and transforms the parasitic components associated with the package of discrete p-HEMT. It is appropriate loading impedances 9 to be implemented as a transmission line sections with length about λ/4 and/or λ/8 having determinate characteristic impedance, and tapered lines for smooth transition toward the p-HEMT switch. To maintain good decoupling between control terminal and microwave part of the circuit, decoupling network 10 is added. It can comprise two sections of transmission lines and/or resistor. One preferred embodiment of phase shifting bit with described matching is depicted in FIGS. 2*b*, 2*c* and 2*d*. All of these configurations are in microstrip implementation and use as e loading impedance network 9, series connection of quarter wavelength transformer 9*a*, λ/8 transforming microstrip line 9*b* and tapered line 9*c*. The decoupling networks 10 are the same and is build from series connection of high impedance λ/4 transmission line 10*a* and open low impedance λ/4 stub 10*b*. The phase shifting cells shown in FIGS. 2*b* and 2*c* use the same impedance matching networks 7 and 8, implemented like λ/4 transformer 7 and 8, and single open stub Γ-network 7*a*, 7*b* and 8*a*, 8*b*. FIG. 2*d* illustrates preferred embodiment of phase shifting bit with matching through initial loading of the transmission line with capacitive reactance 13. In described embodiments the discrete p-HEMT works as a grounded switch with two source terminals 11*a* and 11*b*, connected to common ground 12 of the circuit, drain 11*d*, connected to impedance loading network 9 and gate 11*c*, connected to control terminal 4*k* through decoupling network 10. The described embodiment is suitable for implementation of small phase delays within the range of 2° to 20° with relative bandwidth of 25%. The circuits presented in FIGS. 3 and 4 are known except for the application of discrete p-HEMT and will not be described in details. Periodically loaded line phase shifting bit is depicted in FIG. 3, it uses pear of discrete p-HEMTs to switch the loading impedances at the input and output of the cell in nodes a and b. The switching of loading impedances leads the change of the phase of transmission coefficient. The function of impedance loading networks 17 and 18 and the decoupling network 19 and 20 is the same as impedance loading network 9 and the decoupling network 10. Physical layout of such phase shifting cell is depicted in FIG. 3*b*. This is microstrip implementation; loading networks 17 and 18 have the same configuration as loading network 9 with the difference that quarter wavelength transformer is bended on 45°. Decoupling networks 19 and 20 are the same like decoupling network 10 except the application of radial open stab 19*b* and that λ/4 transformer 19*a* is bended as well. FIG. 4 shows reflection type hybrid coupled phase shifting bit, which uses discrete p-HEMT for the control of reflective loads that are connected to the transmission line 24 through hybrid circuit 26. The change of reflective terminations changes the phase relation between forward and backward waves and thus the phase of transmission coefficient. The function of loading networks 27 and 28, and decoupling networks 29 and 30 is the same as impedance loading network 9 and decoupling network 10. Hybrid circuit can be implemented as a branch-line coupler, coupled-line directional coupler, Lange coupler, hybrid ring coupler with 90° compensation or theirs discrete element counterparts. Microstrip implementation of this phase shifting bit using single-section branch-line coupler 26 is depicted in FIG. 4*b*. Both reflective terminations 27 and 28 are equal and consists of series connection of microstrip line 27*g* with impedance Zo, tapered line 27*e*, microstrip line 27*d* with impedance Z1, tapered line 27*c*, microstrip line 27*b* with impedance Z2 and tapered line 27*a*. The applied decoupling networks are similar to decoupling networks 19 and 20. Similar embodiment using double-section branch line coupler 26 is depicted in FIG. 4*c*.

Figure 5:
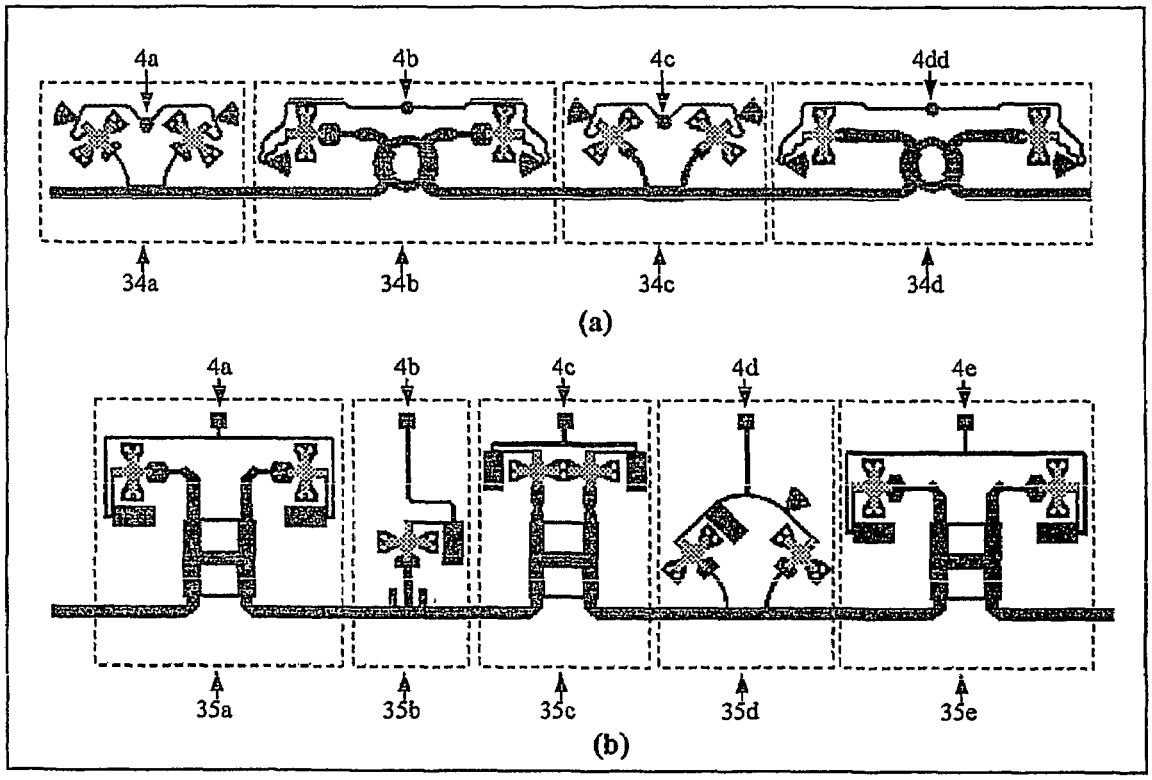
FIG. 5*a* is physical layout of four-bit phase shifter implemented on microstrip technology.
FIG. 5*b* is physical layout of five-bit phase shifter implemented on microstrip technology.

Complete embodiment of phase shifter apparatus is shown in FIG. 5*a*. This is four-bit phase shifter comprising four phase shifting cells 34*a*-*d*, which is capable to maintain phase change in the range of 0° to 337.5° with phase step of 22.5°. The apparatus operates at 12.5 GHz with 8% relative bandwidth and ±5° phase error. The periodically loaded line phase shifting bits 34*a* and 34*c* provide phase delay of 22.5° and 45° and were presented in details in FIG. 3. The phase shifting bits 34*b* and 34*d* are reflection type hybrid coupled cells using single-section branch-line coupler. These are presented in details in FIG. 4*b* and provide phase delay of 90° and 180°. Five-bit phase shifter apparatus is depicted in FIG. 5*b*, which can insure phase change in the range of 0° to 348.75° with phase step of 11.25°. It operates at 11.7 GHz with relative bandwidth of 17% and ±5° phase error. Phase shifting bit 35*b* is loaded line type presented in details in FIG. 2. This cell provides 11.25° phase delay. Periodically loaded line phase shifting bit 35*d* provides 22.5° phase delay. The phase cells 35*a*, 35*c* and 35*e* are reflection type hybrid coupled cells using double-section branch-line coupler and are presented in FIG. 4*c*. They provide phase delay of 90°, 180° and 45°. Any kind of combinations of described phase shifting bits using discrete p-HEMTs are possible to achieve the desired phase range with needed phase step.

Other Applications

Phase shifter apparatus build with one phase shifting bit with phase delay of 180° can be used to yield binary phase shift keying (BPSK) signals, appropriate in this case is application of reflection type hybrid coupled phase shifting bits depicted in FIGS. 4*b* and 4*c*. Utilization of two 180° phase shifting bits with 90° out of phase division of the input signals and in-phase summation of the outputs yields quadrate phase shift keying (QPSK) signal. Another way for implementation of QPSK signals by the use of presented embodiment is building a 2-bit phase shifter with cells having 90° and 180° phase delay.

The invention claimed is:

1. A digital phase shifter, comprising a series connection of controlled phase shifting cells, each configured to insert a determinate amount of phase delay of a passing signal, wherein insertion of the determinate amount of phase delay occurs in response to switching of one or more of the controlled phase shifting cells caused by applying a control signal to a steering terminal for a switching element of each of the one or more of the controlled phase shifting cells wherein the switching element includes a discrete p-HEMT (pseudomorphic high electron mobility transistors) and applying the control signal includes applying a positive or negative pinch-off voltage to the discrete p-HEMT.

2. The digital phase shifter as in claim 1, characterized in that at least one of the phase shifting cells is of a loaded line type and wherein a switching component of the at least one of the phase shifting cells is configured for phase change, impedance matching and loading networks, wherein the switching component of the at least one of the phase shifting cells is further configured to operate as a grounded switch with both sources connected to a common ground, a drain connected to the loading network and a gate connected to a control terminal through a decoupling network.

3. The digital phase shifter as in claim 2, characterized in that the impedance matching networks are implemented as quarter wavelength transformer, single stub Γ-networks and through loading of a transmission line with reactance compensating reactive loading from the switching component and the loading network.

4. The digital phase shifter as in claim 2, characterized in that the loading network is implemented as a transmission line section with approximate length of λ/4 and/or λ/8 with determinate characteristic impedance, and tapered line for smooth transition toward the switching component.

5. The digital phase shifter as in claim 2, characterized in that the decoupling network comprises two sections of transmission line and/or resistor.

6. The digital phase shifter as in claim 2, characterized in that the loading network is a series connection of a quarter wavelength transformer, a λ/8 transforming microstrip line and a tapered line.

7. The digital phase shifter as in claim 6, characterized in that the decoupling network comprises a series connection of a high impedance λ/4transmission line and an open low impedance λ/4 stub.

8. The digital phase shifter as in claim 7, characterized in that the impedance matching networks are implemented as a λ/4 transformer.

9. The digital phase shifter as in claim 7, characterized in that the impedance matching networks are implemented as a single open stub Γ-network.

10. The digital phase shifter as in claim 7, characterized in that impedance matching is implemented through initial loading of the transmission line with capacitive reactance.

11. The digital phase shifter as in claim 1, further comprising at least two loading networks and at least at two decoupling networks, each of the loading networks and the decoupling networks are connected to a gate of at least one switching element, and wherein the steering terminal is disposed between the at least two decoupling networks.

12. The digital phase shifter as in claim 11, characterized in that the at least two loading networks are configured such that a quarter wavelength transformer is bended on 0°, 45° or 90°.

13. The digital phase shifter as in claim 11, characterized in that the at least two decoupling networks are configured to use a radial open stub and wherein a high impedance λ/4 transmission line is bended.

14. The digital phase shifter as in claim 11, characterized in that at least one of the controlled phase shifting cells is of a reflection type and comprises two switching components for controlling reflective loads, wherein the two switching components are connected to the transmission line through a hybrid circuit, where the sources of the switching components are connected to the hybrid circuit through impedance matching networks, and their gates of the switching components are connected to the steering terminal by a second decoupling network different from the at least two decoupling networks.

15. The digital phase shifter as in claim 14, characterized in that the hybrid circuit is implemented as a branch-line coupler, coupled line directional coupler, Lange coupler, hybrid ring coupler with 90° compensation or discrete element counterparts thereof.

16. The digital phase shifter as in claim 14, further comprising a single-section branch-line coupler, two equal reflective terminations, the two equal reflective terminations including a series connection of a microstrip line with impedance Zo, a first tapered line, a microstrip line with impedance Z1, a second tapered line, a microstrip line with impedance Z2 and a third tapered line.

17. The digital phase shifter as in claim 14, further comprising a double-section branch-line coupler, two equal reflective terminations, the two equal reflective terminations inc1uding a series connection of microstrip line with impedance Zo, a first tapered line, a microstrip line with impedance Z1, a second tapered line, a microstrip line with impedance Z2 and a third tapered line.

* * * * *